US007370686B2

(12) United States Patent
Rasmussen

(10) Patent No.: US 7,370,686 B2
(45) Date of Patent: May 13, 2008

(54) MOUNTING DEVICE FOR ROLLER BLINDS

(75) Inventor: Ken Rasmussen, Ringe (DK)

(73) Assignee: Faber A/S, Ryslinge (DK)

( * ) Notice: Subject to any disclaimer, the term of this patent is extended or adjusted under 35 U.S.C. 154(b) by 222 days.

(21) Appl. No.: 10/507,287

(22) PCT Filed: Mar. 12, 2003

(86) PCT No.: PCT/DK03/00152

§ 371 (c)(1),
(2), (4) Date: Jun. 17, 2005

(87) PCT Pub. No.: WO03/076757

PCT Pub. Date: Sep. 18, 2003

(65) Prior Publication Data

US 2005/0224196 A1 Oct. 13, 2005

(30) Foreign Application Priority Data

Mar. 12, 2002 (DK) ..... 2002 00374

(51) Int. Cl.
*E06B 9/17* (2006.01)

(52) U.S. Cl. ..... 160/323.1; 160/326; 242/404; 403/353; 248/268

(58) Field of Classification Search ..... 248/266, 248/267, 268, 222.11, 222.52, 224.7; 160/323.1, 160/324, 325, 326; 242/586, 586.1, 586.2, 242/586.3, 586.4, 586.5, 404, 599.3; 70/379 R, 70/380; 403/353

See application file for complete search history.

(56) References Cited

U.S. PATENT DOCUMENTS

| | | | | |
|---|---|---|---|---|
| 729,881 | A * | 6/1903 | Mathis | 248/268 |
| 778,649 | A * | 12/1904 | Flores | 24/645 |
| 1,409,722 | A * | 3/1922 | Hutchinson | 248/268 |
| 2,155,944 | A * | 4/1939 | Weaver | 160/174 R |
| 2,420,977 | A * | 5/1947 | Pye | 248/258 |
| 4,399,857 | A * | 8/1983 | Honma | 160/323.1 |
| 5,009,259 | A * | 4/1991 | Miloslaus | 160/323.1 |
| 5,450,891 | A | 9/1995 | Benthin | |
| 6,457,688 | B1 * | 10/2002 | Welfonder | 248/266 |
| 6,877,703 | B2 * | 4/2005 | Tang | 248/342 |

FOREIGN PATENT DOCUMENTS

| | | |
|---|---|---|
| EP | 1006255 A1 | 6/2000 |
| NL | 8400103 A | 8/1985 |

* cited by examiner

*Primary Examiner*—Blair M. Johnson
(74) *Attorney, Agent, or Firm*—Pearne & Gordon LLP

(57) ABSTRACT

A roller blind tube with fabric wound around it is mounted in brackets that have spade-shaped elements (3) provided in the axis. These elements cooperate with oblong holes (2) in terminating plugs (1) in the roller blind tube. According to the invention the oblong holes (2) are opened by rotating excentrically built rings (8). Hereby the roller blind may be hung on the brackets, whereupon the rings (8) are closed again.

6 Claims, 3 Drawing Sheets

MOUNTING DEVICE FOR ROLLER BLINDS

BACKGROUND OF THE INVENTION

The invention relates to a mounting device for roller blinds comprising a terminating plug for a roller blind tube, said plug having an oblong hole for interaction with a spade-shaped element on a mounting bracket, in which at least one longer side of the hole being shaped as a plane surface parallel to the axis at a distance from said axis corresponding to half the thickness of the spade-shaped element, and that there is provided a lock, which is constituted of the inside of a slit circular ring, rotatable to locking around said spade-shaped element upon mounting.

Several conditions have to be fulfilled when mounting roller blinds with a built-in spring. One end must be prevented from rotating, and the roller blind mounting bracket must be fitted as closely as possible to the upper delimitation of a niche or cassette. Traditionally the rotation is prevented by means of a spade-shaped element, which projects axially into or out of the roller blind tube, interacting with a hole that surrounds the flat element in a suitable manner. In another type of roller blinds having exterior winding and unwinding both ends have to rotate. This is in practice obtained by using spade-shaped elements in both brackets, which may be identical, and the rotation is assured by means of a bearing built into the terminating plugs fitted to the roller blind tube. The length of the roller bearing tube should correspond to the width of the niche, and hence the mounting is traditionally performed by mounting one end of the tube in one of the brackets, whereupon a projecting spade-shaped element is pushed horizontally into a slit in the other bracket, whereupon it is swung down to be supported and held in the centre of the bracket. The force of gravity ensures that this end remains in the bracket. Conditions are not the same, if the spade-shaped element is carried by the bracket and has to interact with a hole in one end of the roller blind tube. In this situation it is necessary that both ends are fitted with brackets, and that one of them is subsequently fixed by screws. It is a complicated mounting, which is unsuitable if corrections have to be performed on the roller blind, that may necessitate its removal once again.

Known mounting brackets may have a horizontal as well as a vertical spade-shaped element. It is not possible to transfer the slit in the bracket to one of the roller blind, because this slit would not have a suitable orientation, whereby a sideways pull in the roller blind would be able to pull it loose. In case space were made available in the end of the roller blind for a construction so that the roller blind were retained by means of the force of gravity, it must then be lifted so much with respect to the bracket, that both brackets have to be lowered during mounting (to preserve the horizontal axis of the roller blind), and hence the roller blind is not fitted as closely as possible to the upper delimitation as possible. Furthermore it would not be possible to use a mounting bracket having a vertical spade-shaped element.

BRIEF SUMMARY OF THE INVENTION

According to the invention a solution to this problem has been provided, in that it has been realised that the hole that is to interact with the spade-shaped element does not need to have a precisely rectangular cross section. The construction is hence particular in that the ring is carried by a cylindrical part of the plug that is fitted eccentrically with respect to the axis of the tube, and the other long side of the hole is constituted by the inner surface of the ring. By means of the slit an opening is created, in order that the end of the roller blind may be pushed over the spade-shaped element, and by rotating the ring the opening is closed again. The turning of the ring may be eased by providing it with ridges on its circumference. Both horizontal and vertical spade-shaped elements may be used.

According to a preferred embodiment of the invention the shorter sides of the hole are disposed as cuts in the cylinder which carries the ring, with a distance between them corresponding to the width of the spade-shaped element. This construction causes the oblong hole to fit closely around the spade-shaped element when closed.

A further advantageous embodiment is particular in that the ring has an outer diameter corresponding to the outer diameter of the roller blind, that it is eccentric, with the slit at the thinnest location, and that the edge parts of the slit have sufficient strength to carry the weight of half the roller blind inclusive of the fabric. The advantage of this embodiment lies in particular in that the ring is rotated out of the cylindrical surface and hangs down in certain orientations, when the mounting is to take place. Partly this demonstrates that the roller blind bracket is unlocked, it prevents operation of the roller blind, and it eases the rotation of the ring to its locked position. This embodiment may in a simple manner be used for both horizontal and vertical spade-shaped elements on mounting brackets. Hereby it is ensured that it is unnecessary to support the corresponding part of the roller blind during the mounting and until the ring is in its locked position, but the roller blind may be carried fully by the brackets, even during the not yet quite finished mounting operation.

A further advantageous embodiment is particular in that the ring has an outer diameter corresponding to the terminating plug, while the terminating plug has been fastened to a roller blind tube by means of a diameter conversion ring. By means of this construction the same mounting device may be used for tubes of different diameters, by just inserting a diameter conversion ring or a tube between the terminating plug unit and the inside of the roller blind tube. There will still be provided a bearing in the terminating plug that ensures the rotation of the roller blind.

A use of the mounting device is particular in that two roller blind brackets are fitted at a distance that corresponds to the length of a roller blind tube with a sheet of fabric wound around it and with terminating plugs, that the rings are rotated in a position such that the oblong holes are opened, that the roller blind tube is lifted to interact with the spade-shaped elements at both ends by means of the opened holes, that the rings are again rotated to close the holes and hence ensure the terminating plugs against turning and to retain the roller blind.

BRIEF DESCRIPTION OF THE SEVERAL VIEWS OF THE DRAWINGS

The invention will be further described with reference to the drawing, in which.

DETAILED DESCRIPTION OF THE INVENTION

Figure 1:
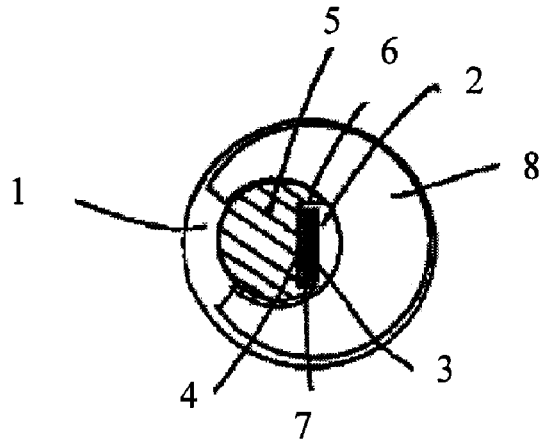
FIG. 1 shows a plug for use in a roller blind tube for a vertical spade-shaped element with an embodiment of the invention in a closed condition.

In FIG. 1 is shown the end of a plug 1 for use at the right end of a roller blind, in which plug there is an oblong hole 2 that has to enclose the spade-shaped element 3 that is a part of a bracket. This hole is delimited by the straight longer side 4 which is shaped as a surface in a cylindrical part 5 provided on the plug, two shorter sides 6, 7, which are perpendicular to the surface 4, and the inside part of a ring 8. The ring is eccentric, whereby it has obtained a varying thickness along its circumference. The ring 8 is carried by the cylindrical part 5 of the plug, which is eccentric with respect to the axis of the roller blind with the same axis displacement as the eccentricity of the ring. The ring is provided with ridges in the edge (not shown), in order that it may be grabbed and rotated. The ring is internally provided with a circular tongue that is shorter than the corresponding groove in the cylindrical part of the plug, so that the rotation of the ring with respect to the plug, and hence the roller blind, is limited to a specific angular interval.

Figure 2:
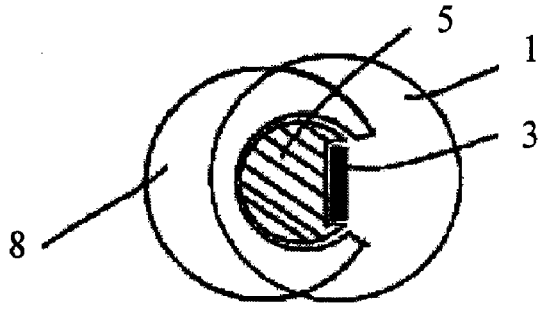
FIG. 2 shows the same, only in an open position.

In FIG. 2 the ring 8 is seen rotated out with respect to the plug 1, such that the oblong hole 2 is opened. Hereby the end of the roller blind may be held against a vertical spade-shaped element 3. The ring is turned counterclockwise around the cylinder 5 until the condition shown in FIG. 1 is obtained.

Figure 3:
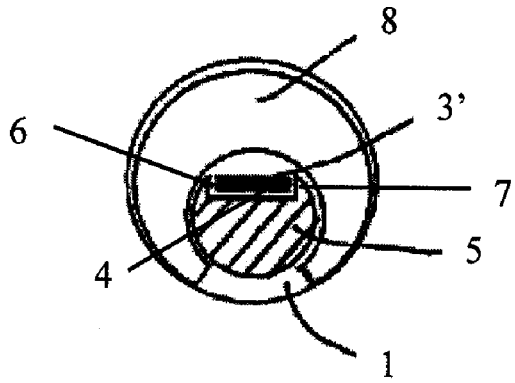
FIG. 3 shows a plug for use in a roller blind tube for a vertical spade-shaped element with the same embodiment of the invention in a closed condition.

Correspondingly, in FIG. 3 the same construction is shown, consisting of the plug 1, the cylindrical part 5 with the recess 6, 4, 7 and the surrounding eccentric ring 8. The end of the roller blind tube is carried by a horizontal spade-shaped element 3', which is a part of a bracket.

Figure 4:
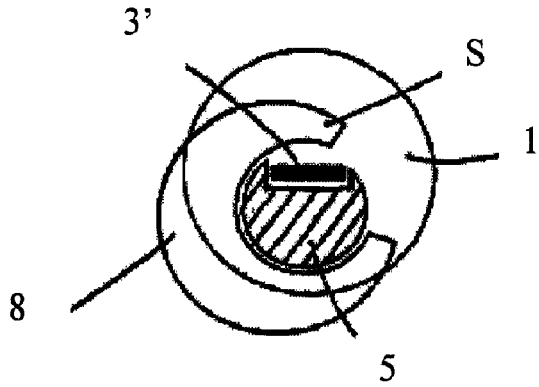
FIG. 4 shows the same, only in an open position.

In FIG. 4 the ring 8 is seen rotated out with respect to the plug 1. In this position the roller blind may be lifted and pushed to the right, in order that the thin part S of the ring 8 rests on the spade-shaped element 3'. Subsequently the ring 8 is turned clockwise around the cylinder 5, until the condition shown in FIG. 3 is obtained.

The plug is shown as used in the right-hand end of a roller blind, but it is obvious that precisely the same construction may be used in the left-hand end. In this case the directions of rotation for the ring 8 seen relative to the left end of the roller blind shall be reversed for locking.

Figure 5:
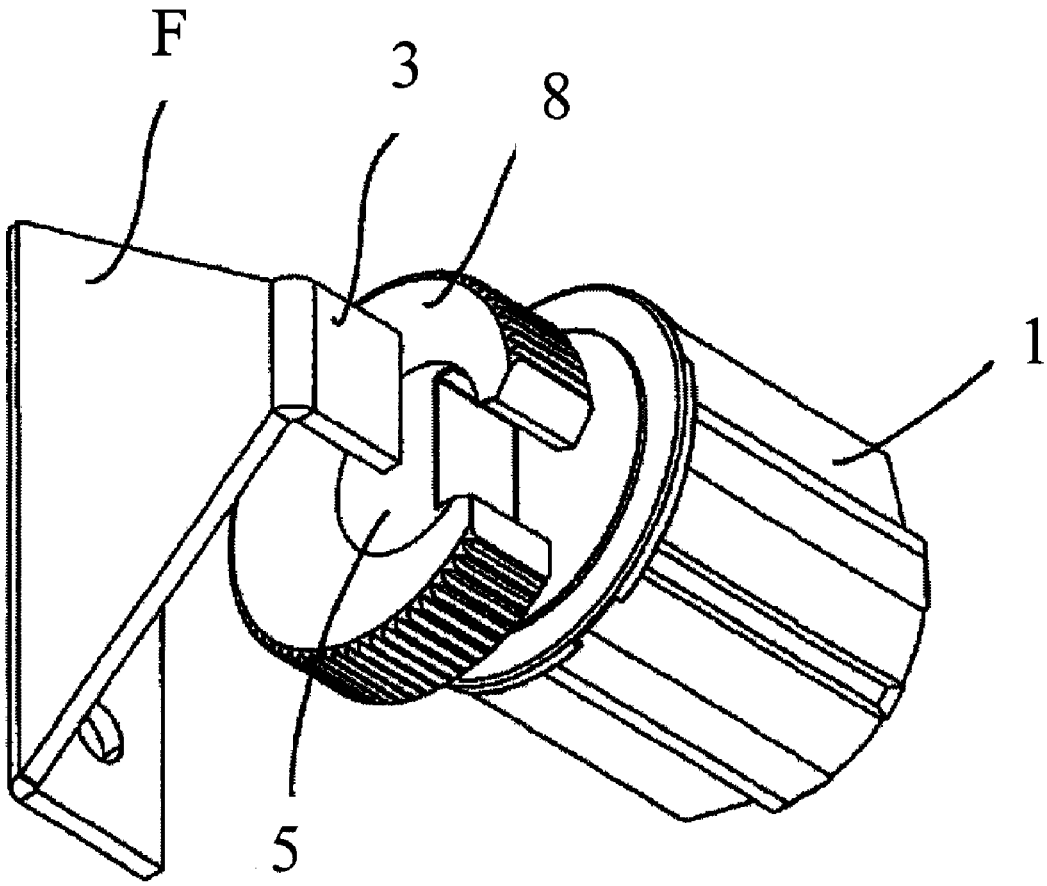
FIG. 5 is a perspective drawing of a roller blind bracket and an opened locking ring according to the invention.
Figure 6:
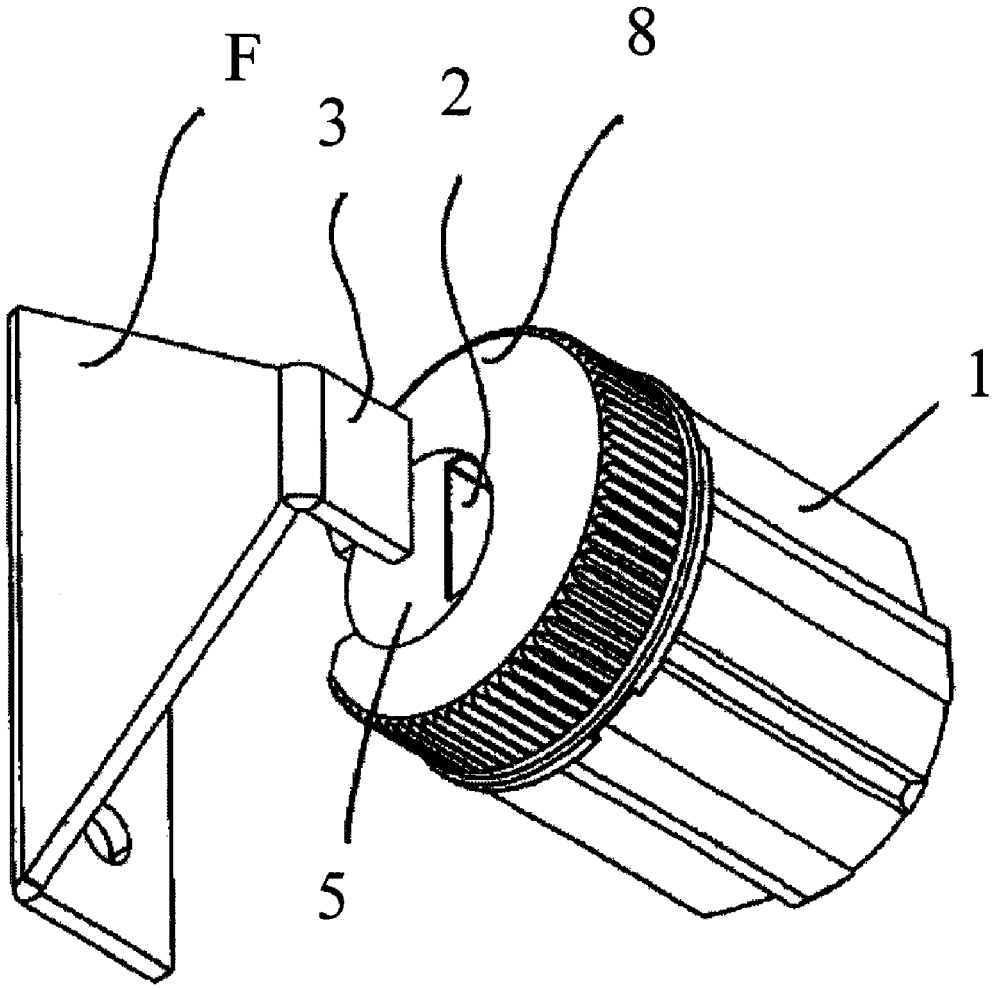
FIG. 6 shows the same components, but with a closed locking ring.

In FIG. 5 is seen a roller blind bracket F with a spade-shaped element 3, which is shown ready to be screwed to a vertical constructional element. The ring 8 on the cylindrical and eccentric part 5 of the terminating plug 1 is rotated into a position corresponding to FIG. 2, but which is in the present instance used in the left-hand side of the roller blind, and the direction of mounting is in this case from the inside and out. It will be seen that the end of the roller blind is hanging very well in the hook that is created by the thin end S of the ring 8. In FIG. 6 is shown that the oblong hole 2 is closed around the spade-shaped element 3 in a position that corresponds to FIG. 1. In order to improve clarity the end of the roller blind has been pulled out from the bracket in the drawing.

The invention claimed is:

1. A mounting device for roller blinds comprising a terminating plug (1) adapted to be mounted on an end of a roller blind tube, the plug having an axis adapted to be coaxial with the axis of the blind tube, said plug having an oblong hole (2) for interaction with a spade-shaped element (3) on a mounting bracket (F), in which at least one longer side (4) of the hole being shaped as an essentially plane surface parallel to the axis of the plug at a distance from said axis, and that there is provided a lock, which is constituted of a circular ring (8) having a slit therein, rotatable to lock around said spade-shaped element (3) upon mounting, characterised in that the ring (8) is carried by a cylindrical part (5) extending from an end of the terminating plug (1) that is fitted so as to have an axis that is eccentric with respect to the axis of the plug, and where another longer side of the hole is constituted by the inner surface of the ring (8), the space between the one longer side and the other longer side is adapted to receive the spade-shaped element so as to be coaxial with the axis of the plug.

2. A mounting device for roller blinds comprising a terminating plug (1) adapted to be mounted on an end of a roller blind tube, the plug having an axis adapted to be coaxial with the axis of the blind tube, said plug having an oblong hole (2) for interaction with a spade-shaped element (3) on a mounting bracket (F), the oblong hole having opposing longer sides and opposing shorter sides, and that there is provided a lock, which is constituted of a circular ring (8) having a slit therein, rotatable to lock around said spade-shaped element (3) upon mounting, characterised in that the ring (8) is carried by a cylindrical part (5) extending from an end of the terminating plug (1) that is fitted so as to have an axis that is eccentric with respect to the axis of the plug, and the shorter sides (6, 7) of the hole are disposed as cuts in the cylinder (5), with the oblong hole adapted to receive the spade-shaped element (3).

3. A mounting device according to claim 1, characterised in that the ring (8) has an outer diameter adapted to correspond to the outer diameter of the roller blind, tube the ring being eccentric, with the slit at the thinnest location of the ring, and that edge parts (S) of the slit have sufficient strength to carry a weight of half the roller blind inclusive of a fabric.

4. A mounting device according to any of the preceding claims, characterised in that the ring (8) is internally provided with a circular tongue that is shorter than a corresponding groove in a cylindrical surface of the terminating plug (5).

5. A mounting device according to claim 1, characterised in that the ring (8) has an outer diameter corresponding to a diameter of the terminating plug (1), when the terminating plug is fastened to the roller blind tube.

6. A mounting device according to claim 4, further characterised in that two roller blind brackets (F) are fitted at a distance that corresponds to the length of the roller blind tube with fabric wound around it and with respective terminating plugs (1) at its ends, the rings (8) are rotatable into a position such that the oblong holes (2) are opened, that the roller blind tube is liftable to interact with respective spade-shaped elements (3) at both ends by means of accessing the oblong holes (2) through the slits, the rings (8) being rotatable to close the holes (2) and thereby securing the end plugs (1) against turning and retaining the roller blind.

* * * * *